United States Patent [19]

Jukes

[11] 4,348,847

[45] Sep. 14, 1982

[54] SPACER EXTENDER

[75] Inventor: Christopher E. Jukes, Vancouver, Canada

[73] Assignee: Mod-Lok Industries Ltd., Vancouver, Canada

[21] Appl. No.: 194,007

[22] Filed: Oct. 6, 1980

[51] Int. Cl.[3] ..... E04B 1/16

[52] U.S. Cl. ..... 52/426; 52/309.11; 52/383; 52/713; 403/300

[58] Field of Search ..... 52/426, 381, 383, 712, 52/713, 715, 309.11, 405, 504, 444, 428; 403/300, 205

[56] References Cited

U.S. PATENT DOCUMENTS

| | | | |
|---|---|---|---|
| 2,372,042 | 3/1945 | Yankee | 52/426 |
| 2,919,572 | 1/1960 | Salzi | 52/712 X |
| 3,445,977 | 5/1969 | Latiano | 52/715 X |
| 3,676,967 | 7/1972 | Frati | 52/715 X |
| 3,725,976 | 4/1973 | MacKeown | 403/300 |
| 3,788,020 | 1/1974 | Gregori | 52/426 X |
| 4,149,349 | 4/1979 | Nilsen et al. | 52/712 X |

FOREIGN PATENT DOCUMENTS

| | | | |
|---|---|---|---|
| 2029175 | 3/1972 | Fed. Rep. of Germany | 52/426 |

*Primary Examiner*—J. Karl Bell
*Attorney, Agent, or Firm*—Harlan P. Huebner

[57] ABSTRACT

A pre-fabricated consumable spacer extender on locking plate for use with a consumable wall assembly for forming a concrete wall in order to form a column or pilaster. A plate or plates are adapted to engage and lock two or more tie members of the wall assembly in an extended length greater than the normal width of a wall block assembly which is usually one tie member in width.

The consumable locking plate includes preformed slots to mate with projections on said tie members wherein when assembled the projections may be distorted to fixedly lock the tie members together creating a rigid strength member to assure proper columns when the assembly is filled with concrete.

8 Claims, 6 Drawing Figures

FIG. 3.
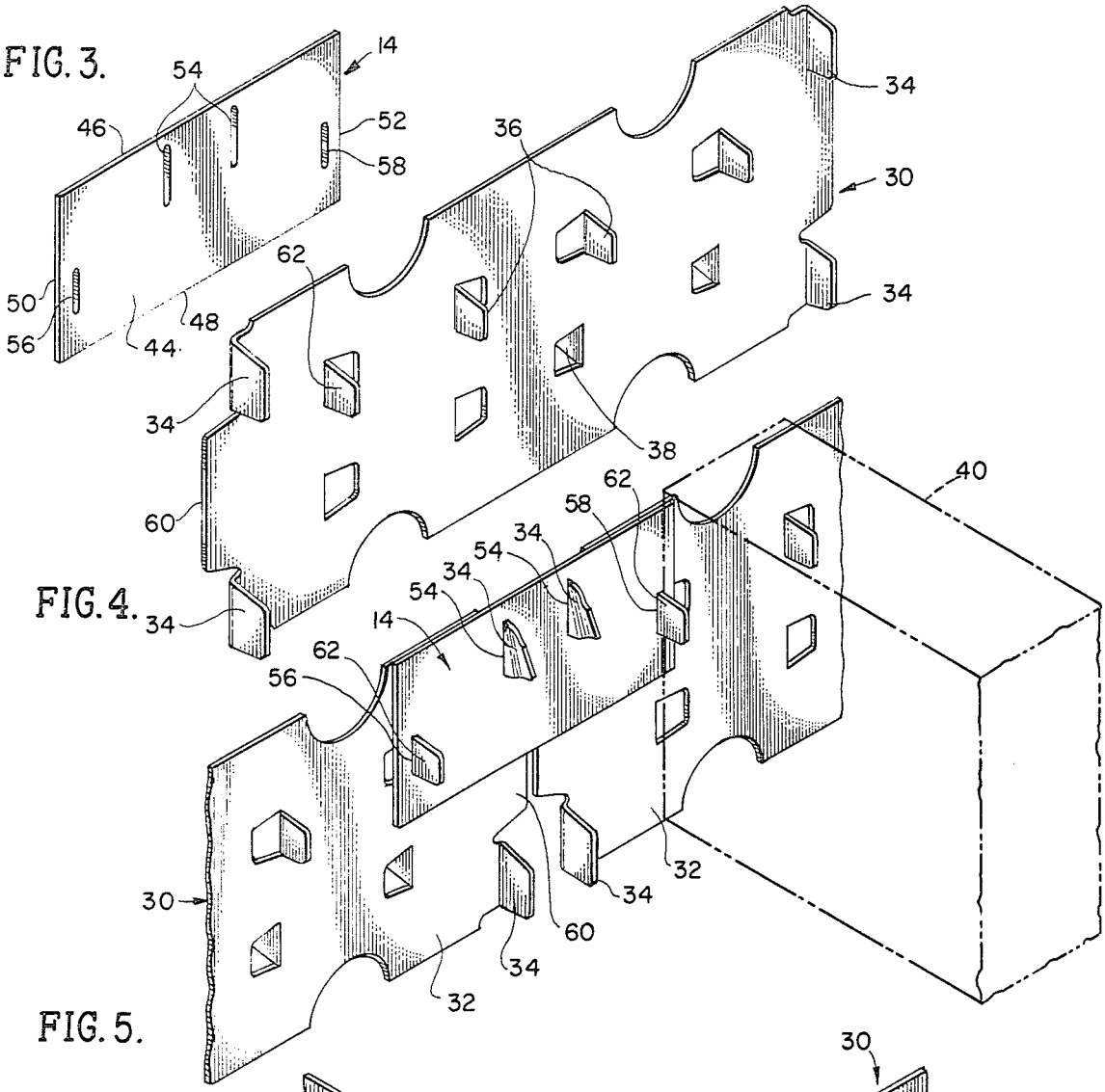
FIG. 4.
FIG. 5.
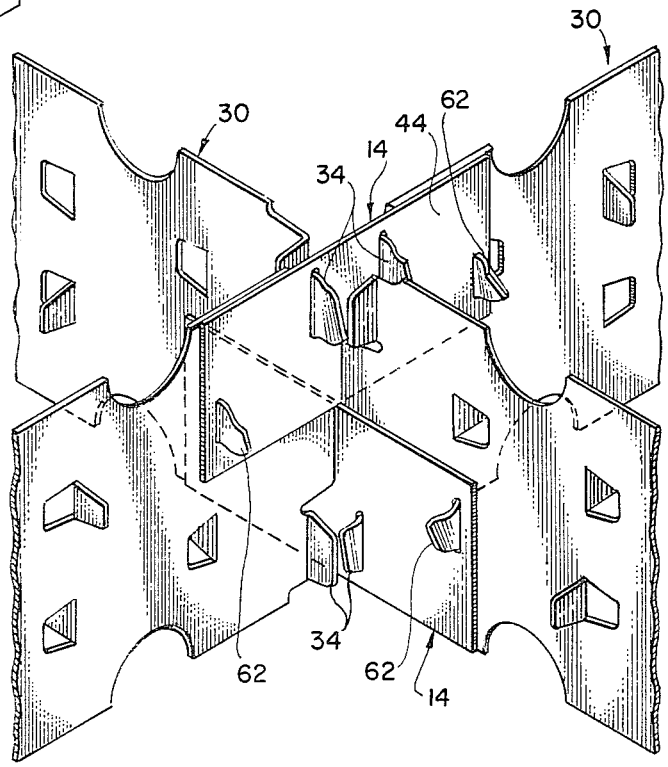
FIG. 6.

SPACER EXTENDER

BACKGROUND OF THE INVENTION

The present invention relates to a pre-fabricated consumable spacer extender or locking plate for use with a pre-fabricated consumable assembly for forming a concrete wall structure. Such an assembly is described, illustrated and claimed in the U.S. Pat. No. 4,149,349, granted Apr. 17, 1979. The structure of that patent includes a pair of spaced apart side walls or plates which are in parallel arrangement and interconnected at their respective ends by transverse tie members. These tie members have lugs or tabs which are outwardly struck from the plane of the member to receive insulation material therebetween. A plurality of these assemblies are united together by grooves and tabs to form building structure walls and then upon completion the assemblies are filled with concrete to complete the wall structure.

With the construction of a wall utilizing the assembly of U.S. Pat. No. 4,149,349 there were shortcomings involved when it became necessary to enlarge a thickness of the wall at certain areas which thickness are commonly called pilasters. The purpose of these pilasters is of course, to stiffen the structure at pre-determined parts along the wall. These are the modern evolvement of what are normally referred to as buttresses. The columns or pilasters may be external or internal depending on engineering and design of the structure.

Previous to the evolvement of the subject matter of this invention, whenever it was necessary to form a pilaster or column in a wall structure utilizing the assemblies of U.S. Pat. No. 4,149,349 or other fabricated building structure, wires were used to tie assemblies. In other words there would be a course of the pre-fabricated wall assemblies but at one area where it was desired to increase the thickness of the wall one or more of the side plates were removed and the side plates extended outward from the outer plane of the wall at right angles for whatever distance was necessary to produce the opening necessary for the concrete to be poured increasing the thickness of the wall and forming the pilaster. In order to strap the assemblies together it was necessary as mentioned above to use wire which were very unsatisfactory for many reasons. The makeshift wiring was time consuming and also there was a tendency to stretch the wire which misaligned the side members of the wall assemblies and allowed the wall to bulge which of course is not desired. Additionally, when the wires were stretched across the opening to tie the extended portions together, there was of course an interference with the areas where the insulation was to be placed and thus the insulation in some cases was broken or had to be removed to go around the wires and this of course could cause loss of heat in the final assembly.

Therefore, the need has arisen for some other manner in which to prepare the columns or pilasters when using the building assemblies such as the aforementioned United States Letters Patent.

SUMMARY OF THE INVENTION

It is accordingly an object of the present invention to provide a spacer extender or locking plate which due to its construction may be utilized with the tie members of the wall assembly structure mentioned above whereby one tie member may be aligned with the second tie member so that a plurality of such members may be united together to extend outwardly from the wall plane of the building assembly to whatever distance is required for the pilaster.

It is further object to the present invention to provide a spacer extender which is a pre-fabricated consumable plate having a plurality of slots formed therein which are adapted to mate with projections from the transverse tie members of U.S. Pat. No. 4,149,349 or similar assemblies.

It is another object to the present invention to provide an improved spacer extender whereby when the transverse tie members are united there is a space between the ends of each of the adjacent tie members whereby a second set of tie members united by the spacer extender may be inserted at right angles to the first set.

Another object of the invention is to form a column or pilaster wherein the wall assemblies are braced both longitudinally up the wall and transversely along the wall. By using the spacer extender such bracing is assured.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 3 is a perspective view of a spacer extender forming the subject matter of this invention;

FIG. 4 is a perspective view of a single transverse tie member of a wall forming assembly with which the invention is used;

FIG. 5 is a perspective view of the spacer extender positioned and aligning two tie members; and FIG. 6 is a perspective view of a plurality of transversed tie members which are united by the spacer extenders and are positioned together at right angles.

DETAILED DESCRIPTION OF THE PREFERRED EMBODIMENTS

Figure 1:
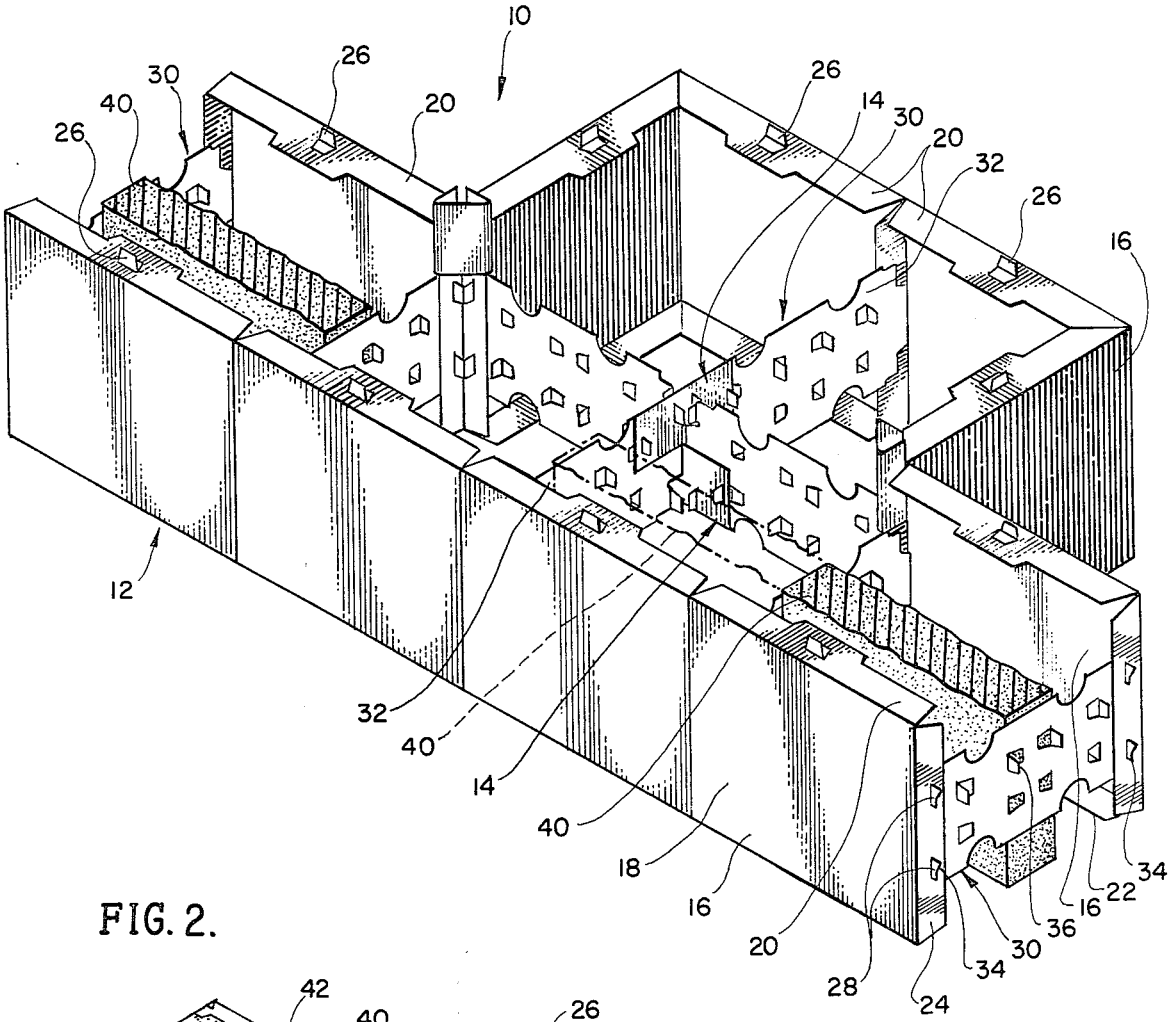
FIG. 1 is a perspective environmental view showing the spacer extender of this invention as it is utilized with wall assemblies to create a pilaster or column.

Referring to the drawings in more detail, as shown in FIG. 1 an assembly generally identified by the numeral 10 is made up of a plurality of consumable wall forming modular blocks generally identified by the numeral 12. The plurality of wall forming modular blocks as shown laid on a single course utilize a spacer extender or locking plate generally identified as 14 (see FIG. 3) to cooperate with the various modular blocks in the formation of a column or pilaster which projects beyond the outer or inner straight plane of the wall formed by the modular blocks.

For purposes of identification a wall forming modular block 12 includes a pair of inner and outer side plates 16 each having a planer body portion 18 surrounded by peripheral edges made up of top and bottom flanges 20 and 22 and opposed end flanges 24. The entire side plate 16 may be formed from a single piece of metal, for example, by stamping with the flanges 20, 22 and 24 making up the edge portions being formed by bending the borders of the planer body 18 into planes perpendicular to the major plane or surface.

It has been found in construction that preferably the length of the respective side plates 16 are made in 8" and 16". These lengths are found most suitable for wall forming with overlapping courses, corner construction or construction of pilasters or columns.

The planer body portions 18 of the modular blocks 12 may be smooth as illustrated in the drawings to form the interior and exterior of a wall or they can be as in U.S. Pat. No. 4,149,349 corrugated whereby plaster or cement may be applied to hide or cover the plates 16.

As further can be seen in FIG. 1 each of the plates 16 include centrally located upper projections, tabs or lugs 26 on the flanges 20. With regard to the bottom flanges 22 of each of the plates 16, they are provided with slots (not illustrated in the drawings) whereby when one side plate is placed upon another such as seen in FIG. 2 the tabs 26 will be inserted through the slot to locate the sideplates in position.

In addition each of the sideplate and flanges 24 have a pair of space apart, vertically aligned slots 28.

Each of the modular blocks 12 are equipped with transverse tie members generally designated 30, best illustrated in FIG. 4. In order to position each of the side plates 16 in parallel spaced relationship, such as seen in FIG. 1, a pair of tie members 30 are connected to the ends of the spaced apart plates 16. In order to accomplish this uniting each transverse tie member 30 includes a plate section 32 which includes a pair of end tabs or lugs 34 which are adapted to extend through the slots 28 in end flanges 24 of the plates 16 such as again shown in FIG. 1. After the tabs or lugs 34 are extended through the slots they may be twisted whereby the tie member 30 is permanently secured through flange 24 to the respective side plates 16. In addition the tie members 30 are formed with central tabs 36. As can be seen from FIG. 4 the tabs 36 extend outwardly from plate section 32 in one direction normal to the plane thereof. In addition there are lower central tabs 38 vertically aligned with tabs 36 which extend outwardly in the opposed direction from tabs 36 projecting from plate 32. The central tabs 36 or 38 are provided to receive sheet insulation 40 which extend between the respective transverse tie members parallel with and spaced from each of the respective side plates 16.

Figure 2:
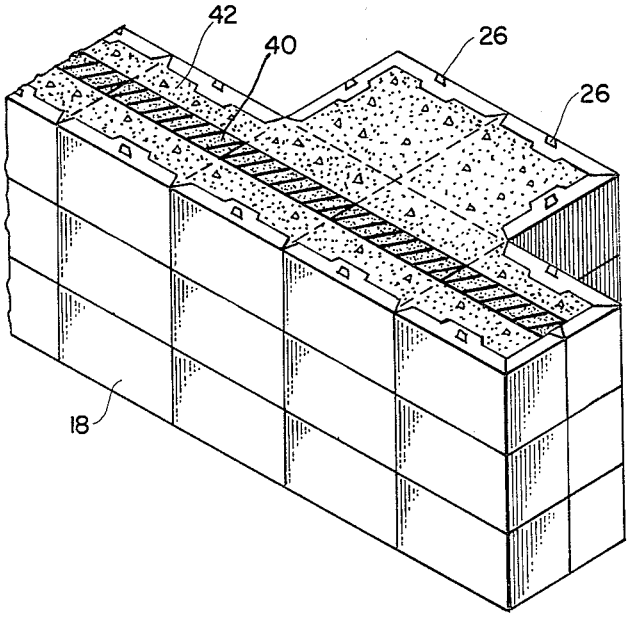
FIG. 2 is a perspective environmental view showing a partial finished wall with a number of courses in place.

In further construction and use when the wall modular blocks 12 are arranged such as seen in FIGS. 1 and 2 concrete 42 is being poured within the modular blocks assemblies on each side of the insulation 40 as best seen in FIG. 2. The wall thus formed is complete leaving exposed the side plates 16 on both the exterior and interior portion of the wall if so desired.

With the advent of walls ranging in height sufficient to require re-inforcing it has been necessary to interrupt the exterior or interior plane of the wall formed by the modular blocks 12 to strengthen by increasing the thickness of the wall. These columns or pilasters have heretofore required interruption of one of the planes of wall 16. A plate 16 of either the same length as the wall plate or shorter as the case may be, is secured to the wall plate at right angles thereto to extend outwardly from the wall. Another plate of comparable length returns to the wall with plates therebetween to form the outline of the column. However, in each particular case there has been no means by which to rigidly inter-connect the plates 16 at the opening across the plane such as seen in FIG. 1. The only way that this could be done was that of securing the wire across the opening to hold the material in place. This however, has proved to be faulty and the wire would stretch and the blocks would become misaligned.

With the advent of the spacer extender 14 as best illustrated in FIG. 3 there has been an ability now to unite two or more of the transverse tie members within the wall and the opening created for the column or pilaster to assure that the form will remain rigid, true and accept the concrete without difficulty. In addition with the advent of the spacer extender 14 of this invention, there is a continuity of the insulation sheets 40 between each transverse tie member in the wall. This will assure an uninterrupted insulation and protect against exterior climatic conditions.

The spacer extender 14 is preferably formed of sheet metal or other material wherein there is a flat plate 44 having parallel top and bottom edges 46 and 48 and parallel end edges 50 and 52. Preferably the thickness of the plate 44 is corresponding to the thickness of the transverse tie members 30.

There is formed in the plate 44 of the spacer extender 14 adjacent the top edge 46 a pair of spaced apart elongated slots 54 each of which has a width corresponding to the thickness of the planer plate 32. In addition to the slots 54 there are additional slots 56 and 58 which are of a lesser length than the slots 54 and are formed in the plate 44 adjacent to respective edges 50 and 52 and below the bottom of the slots 54.

In order to utilize the spacer extender whereby several of the planer plates 32 of the transverse tie members 14 are united such a pair of tie members 30 are positioned side by side whereby the end 60 of one is adjacent the end 60 of the second tie member. The end tabs or lugs 34 at the top of the tie members 30 are then pushed through the slot 54 in the extender 14. As the lugs 34 project through slots 54 additional positioning lugs 62 which are on a horizontal plane with the lugs 36 and projecting in the same direction as the tab 34 can be provided to extend through the slot 56 in case of one of the tie members and in slot 58 of the second tie member 30. As can be seen from FIG. 5 the spacer extenders 30 are preferably united so that there is a space between the end 60 of the receptive plates 32 of tie members 30 as best seen in FIG. 5. In other words the distance between each of the slots 54 is predetermined depending upon the distance between one lug 34 to another lug 34 on the adjacent plate 32. Thus when they are united the space between the ends 60 is of a dimension which is slightly greater than the thickness of the planar plate 32. The purpose for this spacing will become apparent.

With the addition of extending the tabs 62 of the tie members 30 through the pre-positioned slots 56 and 58 and the twisting thereof to lock them it will be seen that the tie members will be in fixed relationship one to the other. When it is desired to extend the plane of the wall outwardly to form the pilaster or the column, a pair of the tie members 30 may be united by the spacer extender 14 so that the thickness of the pilaster will be comparable to the thickness of the wall as seen in FIG. 1 or FIG. 2. If however, it is desired that the pilaster or column be extended an additional distance outwardly therefrom, then an additional tie member 30 may be united with the spacer extender 14 for whatever length is necessary. When the final depth of the column or pilaster is established, the end 60 of one of the tie members 30 will then engage the flanges 24 through the slots 28 to be locked in position by twisting the lugs 26 such as seen in FIG. 1.

In order to complete the rigid construction for the modular walls, there must be some kind of a continuation of the walls in the area where the column is extended outwardly. This is accomplished by means of uniting two or more of the tie members 30 with the spacer extender 14 such as shown in FIGS. 1 and 6 and wherein the united tie members of one unit may be moved into the slot created between the ends 60 whereby there is a cross formed such as seen in FIG. 6. In this way the tie members 30 which are extended in the opposite direction are on the same plane and parallel with the exterior or interior wall as the case may be. By being united in the cross form as seen in FIG. 1 and FIG. 6 there is an additional assurance of stability and rigidity for the entire modular block assembly so that one course may be placed upon the other such as seen in FIG. 2 and when the appropriate insulation 40 has been positioned between the respective tabs 36. Insulation 40 may then be positioned in each block as it is laid and concrete 42 is poured in place to create the complete wall and column or pilaster.

The invention and its attendant advantages will be understood from the foregoing description and it will be apparent that various changes may be made in the form, construction and arrangements of the parts of the invention without departing from the spirit and scope thereof or sacrificing its material advantages, the arrangements herein before described being merely by way of example. I do not wish to be restricted to the specific forms shown or uses mentioned except as defined in the accompanying claims, wherein various portions have been separated for clarity of reading and not for emphasis.

I claim:

1. A spacer extender adapted to be used with a consumable modular predetermined dimensional building block to effectively increase the normal lateral dimension of said block when forming a frame for a pilaster along a wall formed of a plurality of said blocks, wherein said block includes a pair of side plates and a pair of identical transverse tie members at each end of said plates, opposed edge lugs projecting from said tie members to unite with said plates to create a block of rectangular configuration and strength lugs projecting in the same direction as said edge lugs, said block adapted to receive sheet insulation between the interior and exterior of a course of said blocks and to receive concrete therein surrounding said insulation, the improvement comprising, a locking plate to unite at least two tie members, said plate including an upper and lower edge and end edges;

a first pair of slots adjacent said upper edge, one of said slots being adapted to receive one of the edge lugs projecting from one of said tie members and the other of said slots being adapted to receive the edge lug projecting from another tie member when said members are arranged in end to end relationship one with the other;

a second pair of slots in said plate adapted to receive the strength lug from one of said tie members and the other of said second slot adapted to receive the strength lug from said another tie member to increase stability;

said lugs being pliable whereby they may be distorted to permanently affix said locking plate and at least a pair of said tie members together; and said other of said opposed edge lug of one of said united tie members united with one of said side plates and the opposed edge lug of another of said united tie members united with another of said side plates, whereby said side plates are in parallel relationship but of a width greater than the normal predetermined dimensional building block.

2. A spacer extender as defined in claim 1 wherein the upper edge of said tie member is flush with the upper edge of said locking plate and slots of said plate and the width of said lugs being complementary to insure a frictional fit.

3. A spacer extender as defined in claim 1 wherein the second pair of slots in said locking plate are spaced outwardly of said first pair of slots and on a horizontal plane different from the plane of said first pair of slots.

4. A spacer extender as defined in claim 1 wherein more than two tie members are united and wherein additional spacer extenders are required.

5. A spacer extender as defined in claim 1 wherein the said distance between the pair of first slots is such that when the edge lugs of the two tie members are interfitted within the first slots there will be a space between said united tie members.

6. A spacer extender as defined in claim 5 wherein said space is sufficient to accommodate the thickness of a tie member.

7. A spacer extender as defined in claim 6 wherein a second group of united tie members may be interlocked in said space with said first group of united tie members to form a cross, and said locking plate is a height of one half the height of said tie members.

8. A spacer extender as defined in claim 7 wherein the locking plates of said first and second groups of tie members when the members are interfitted will abut the upper edge of one locking plate with the lower edge of another locking plate to prevent the interlocked groups from separating.

* * * * *